US005269526A

United States Patent [19]

Wollstein

[11] Patent Number: 5,269,526

[45] Date of Patent: Dec. 14, 1993

[54] GOLF GAME APPARATUS

[75] Inventor: Devlin S. Wollstein, Queensland, Australia

[73] Assignee: Waggle Pty Ltd., Queensland, Australia

[21] Appl. No.: 761,854

[22] PCT Filed: Sep. 6, 1990

[86] PCT No.: PCT/AU90/00398

§ 371 Date: Sep. 13, 1991

§ 102(e) Date: Sep. 13, 1991

[87] PCT Pub. No.: WO91/03285

PCT Pub. Date: Mar. 21, 1991

[30] Foreign Application Priority Data

Sep. 6, 1989 [AU] Australia ..... PJ6191

[51] Int. Cl.[5] ..... A63B 67/02

[52] U.S. Cl. ..... 273/176 F; 273/181 K; 273/199 R; 273/232; 273/218; 273/221

[58] Field of Search ..... 273/176 F, 199 R, DIG. 20, 273/181 K, 176 FA, 176 FB, 182 R, 232, 218, 221, 184 R, 185 R

[56] References Cited

U.S. PATENT DOCUMENTS

| | | | |
|---|---|---|---|
| 1,574,596 | 12/1926 | Barnett | 273/176 F |
| 3,684,293 | 8/1972 | Brooks | 273/176 F |
| 3,837,653 | 9/1974 | Fox et al. | 273/199 R X |
| 4,248,424 | 2/1981 | Judkins | 273/DIG. 20 X |
| 4,437,672 | 3/1984 | Armantrout et al. | 273/185 B |
| 4,836,552 | 6/1989 | Puckett et al. | 273/DIG. 20 |

FOREIGN PATENT DOCUMENTS

| | | | |
|---|---|---|---|
| 152446 | 3/1952 | Australia | 273/199 |
| 8800486 | 1/1988 | PCT Int'l Appl. . | |

*Primary Examiner*—George J. Marlo

*Attorney, Agent, or Firm*—Hoffman, Wasson & Gitler

[57] ABSTRACT

An indoor golf game including a hole layout area enclosed by netting and a substantially planar rigid or solid rebound surface. A ball is hit from a tee in the hole layout area towards the rebound surface so as to rebound towards a hole in the green area of the hole layout. The ball used in the game comprises a ball having a hard surface so as to provide a feel of a standard golf ball, but a resilience substantially less than a standard golf ball so that the ball resiliently deforms and loses substantial kinetic energy upon striking the rebound surface. The ball has a hardness in the range of 70–105 Durometer, and a resilience in the range of 10%–40%.

17 Claims, 3 Drawing Sheets

GOLF GAME APPARATUS

TECHNICAL FIELD

This invention relates to improvements to games and in particular to a golf type game and apparatus for playing such a game.

BACKGROUND ART

The game of golf at present is a very popular game and its popularity is increasing, particularly with the large number of golf courses which are being constructed. Generally, however, the cost of playing golf is relatively high and the land area occupied by golf courses is considerable. Furthermore playing golf outdoors is often determined by the prevailing weather conditions. A number of golf type games have been proposed in the past such as the game of PUTT-PUTT which can be played indoors or outdoors, however, this game has little similarity to the conventional game of golf. Another golf game which is known is the CHIP AND PUTT game, however, this game is also played outdoors and requires large land areas for playing. Yet a further golf type game uses a computer display to simulate a golf course, however, again this game does not closely approximate the real game of golf.

Other forms of indoor golf games have been described in Australian Patent Application No. 77036/87, and U.S. Pat. Nos. 4,437,672, 3,684,293 and 1,574,596. In Australian application No. 77,036/87, an indoor golf game is disclosed including a plurality of playing areas arranged about a floor surface and a specially formed golf ball is used in the game. In this arrangement, however, the golf ball employed is only designed to go a short distance even when hit with a driver and does not have the run or fly of a normal golf ball so that the game is not a true simulation of the game of golf. U.S. Pat. No. 4,437,672 discloses a golf game simulating apparatus in which an image of a hole is projected onto a screen and a normal golf ball is driven towards the screen. The screen is fixed on a concave wall which serves to direct the ball towards a hole arranged in a putting green. In this arrangement, simulation is provided by the picture on the screen and complex electronic circuitry is required for control of the apparatus. Furthermore, as the concave wall always tends to direct the ball towards the hole, no real skill is involved in aiming the ball at a required position on the wall to achieve a desired direction of rebound. In U.S. Pat. No. 3,684,293 a golf game apparatus is employed which includes an enclosed area and a rebound surface defined by a strip of material which absorbs energy of a standard golf ball which is hit towards the rebound surface. In this case, the position at which the ball is hit is essential to the rebounding nature of the ball.

In U.S. Pat. No. 1,574,596 a ball is struck towards oppositely facing deflecting and retarding plates which deflect the ball into an enclosed field. The apparatus is primarily for golf practice and not a true simulation of a normal golf game.

DISCLOSURE OF THE INVENTION

The present invention aims to provide a golf type game which is primarily aimed for indoor use and which requires skills similar to that required for the normal game of golf. The present invention also aims to provide apparatus for playing the aforesaid game and a ball particularly suited to playing the aforesaid game.

Other objects and advantages of the invention will become apparent hereunder.

With the above and other objects in view the present invention provides games apparatus for a golf-type game, said apparatus including on a ground or floor surface, a tee area, a substantially planar rigid rebound surface at a position spaced from said tee area, a hole layout area including said tee area terminating at said rebound surface, said hole layout area including a hole, and a ball having a relatively hard outer surface so as to provide the feel of a standard golf ball and a resilience substantially less than a standard golf ball so that said ball will resiliently deform and lose substantial kinetic energy on striking said rebound surface, whereby a said ball hit from said tee area towards said rebound surface may strike said rebound surface so as to rebound therefrom towards said hole.

Preferably the hole layout area is provided on opposite sides with upright wall or barrier means which suitably comprise a netting or the like so as to prevent balls struck from said tee area or elsewhere escaping from said hole layout area and also to serve as a flexible barrier from which a ball may be rebounded or deflected. Preferably also, a top wall or barrier is placed over said hole layout area so as to prevent balls escaping therefrom. Suitably also, the top wall comprises a netting or the like.

The hole layout area may be arranged to have features encountered on conventional golf courses such as greens, fairways and rough which suitably may comprise artificial grass of various heights and densities. The hole layout area may also include bunkers as required as well as artificial greenery to simulate trees or bushes.

In one form, said ball has an inner resilient core and an outer surface layer formed of hard or relatively hard material and wherein at least a portion or portions of said inner core are free of said outer layer whereby to permit said ball to resiliently deform on being struck or on striking a surface or the like.

The portion or portions free of said outer layer may be defined by a plurality of generally circumferentially extending slits or slots in the outer layer or alternatively by a plurality of apertures or holes in the outer layer.

The inner core also suitably is defined by hollow ball formed of natural or synthetic rubber the same or similar to that used in the game of squash. In a particularly preferred embodiment, the outer layer is formed of polyurethane.

In a further form, the ball comprises a hollow ball and has a wall formed of a material which provides the required hardness to have the feel of a normal golf ball but which resiliently deforms upon striking the rebound surface. To achieve the required properties in the ball, the wall is formed of a blended mixture of synthetic rubber vulcanizing material and a reinforcing or hardening agent or agents. The synthetic rubber material may suitably comprise rubber butadiene acrylonitrilene copolymer and the hardening or reinforcing agents may be selected from one or more of the following: carbon black, silica, calcium carbonates, silicates and clays. Suitably such agent or agents are present in the synthetic rubber material in the range of 50 to 200 pphr (parts per hundred rubber). Preferably the material forming the ball has a hardness in the range of 70 to 100 Durometer and suitably 95 Durometer. The latter form of ball may include a light filler material such as foam and also may be provided with dimples on its exterior surface giving the appearance of a normal golf ball.

Either ball also suitably has a weight which enables it to run in a similar manner to a normal or standard golf ball although with less momentum after striking the rebound surface and for this purpose the balls suitably have a weight in the range of 20 to 60 grams and most preferably 30 to 50 grams as compared to 40 grams for a normal golf ball. The balls also preferably have a resilience of 15% to 25% which is substantially less than normal golf balls which have a resilience normally in the range of 75% to 80%. The balls also have a size substantially the same as a normal or standard golf ball. Balls having the properties described above have substantially the same trajectory as a normal golf ball between the tee area and the rebound surface when hit although travelling at less velocity.

BRIEF DESCRIPTION OF THE DRAWINGS

In order that the invention may be more readily understood and put into practical effect reference will now be made to the accompanying drawings which illustrate a preferred embodiment of the invention and wherein.

BEST MODE FOR CARRYING OUT THE INVENTION

Figure 1:
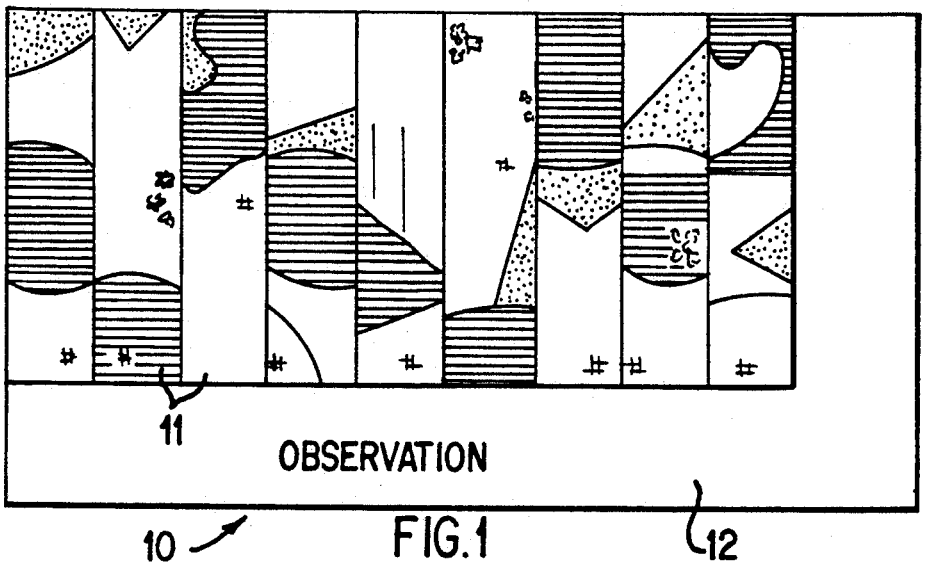
FIG. 1 is a plan view showing a typical layout of a game according to the present invention.
Figure 2:
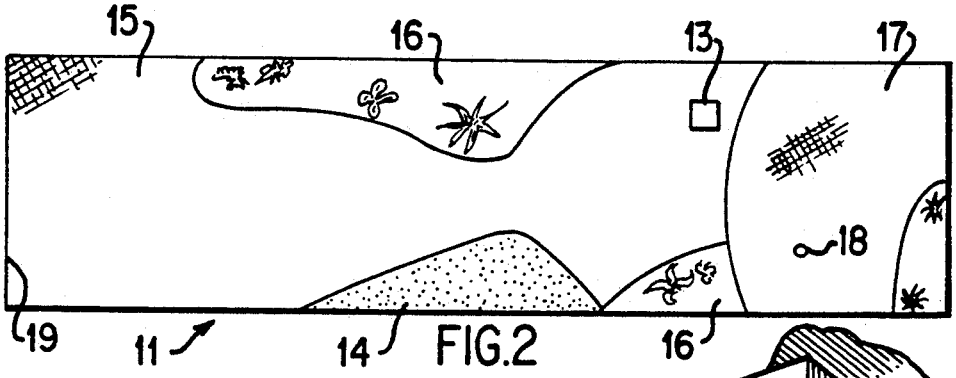
FIG. 2 illustrates in plan view a typical hole layout for the game of FIG. 1.

Referring to the drawings and firstly to FIG. 1 there is illustrated a typical arrangement 10 of game according to the present invention. The arrangement 10 in this embodiment includes nine adjacent hole layouts 11 partially surrounded by an observation area 12. Each hole layout 11 as shown in FIG. 2 may include features associated with a conventional golf hole such as a tee area 13, a bunker 14 (suitably of 15 to 20 cm. in depth), a fairway 15, rough 16 and putting green area 17 which includes a hole or cup 18 (as shown in FIG. 3*a*), the green area 17 in this instance being located rearwardly of the tee area 13. Disposed at a position spaced from the tee area 13 and at the end of the hole layout 11 is an upright solid planar wall 19 which serves as a rigid unyielding rebound surface for balls struck from the tee area 13.

The hole layout area 11 is suitably set up upon a concrete slab and the bunker 14 defined by a recess formed within the slab at the desired position and filled with sand. The surface of the hole layout 11 forming the tee area 13, fairway 15, rough 16 and green area 17 is preferably defined by synthetic grass laid on a shock absorbent underlay and includes piles of different length and density to suit. Thus the carpet forming the green area 17 is formed of short fine pile so that a ball will roll freely thereon whilst the rough 16 is defined by artificial grass having a longer pile so that the ball is inhibited in movement.

Figure 3:
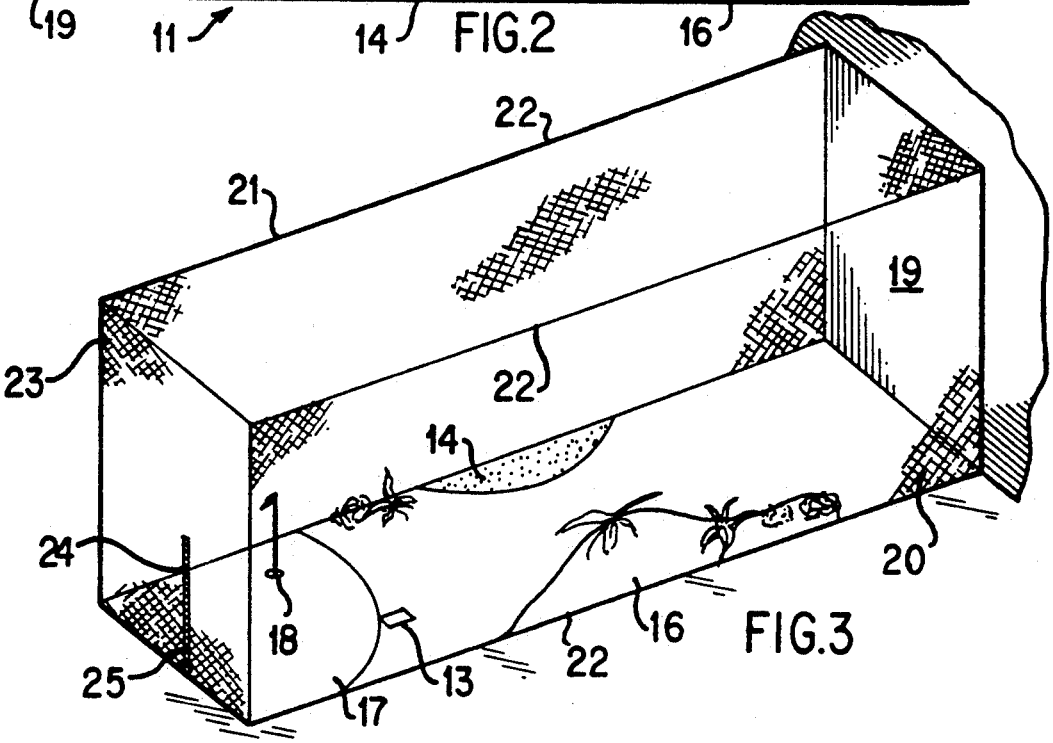
FIG. 3 illustrates in perspective view, one embodiment of hole layout for a hole of the game of FIG. 1.
Figure 3A:
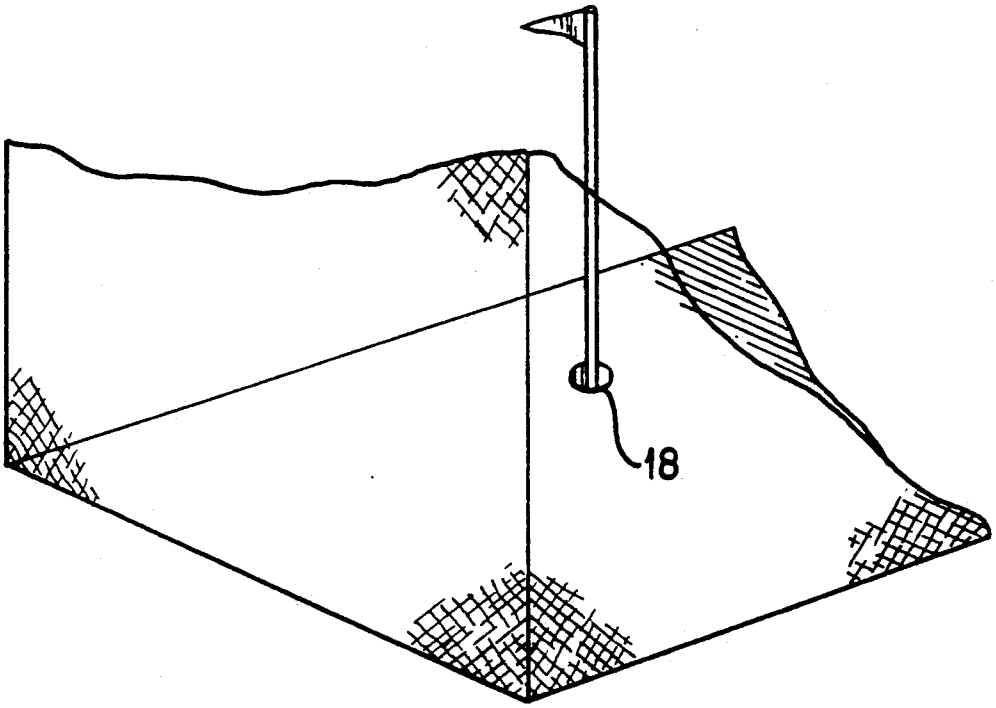
FIG. 3*a* is a partial perspective view of the hole area shown in FIG. 3.

As more clearly shown in FIG. 3, the hole layout area 11 is provided on opposite sides with a protective netting 20 and the top of the hole layout area 11 may also be covered by a netting 21, the netting preferably comprising a woven fabric netting or mesh and being stretched and supported in the case of the side netting 20 along its upper and lower edges by cables 22 secured to the ground surface, and suspended from a roof or elevated and supported in any other manner. The rear of the hole layout area 11 adjacent the tee 13 may also be closed by a netting 23 for protection of observers and also for the purpose of defining a rebound area against which a ball may be struck to avoid obstacles or improve position relative to the hole 18. Formed in the rear wall netting 23 is an upright opening 24 which allows access to players to enter or leave the hole layout area 11, the opening 24 being provided with a zip fastener 25 or any other closure device which may be easily closed to prevent ball escape and protect observers. The netting about the sides, top and rear of the hole layout area 11 is of a mesh size such that the ball used in the game will not pass therethrough. The netting about each layout area also encloses the areas to define confined spaces in which the game is played.

In use the game is played as in the conventional game of golf with a ball being teed up on the tee area 13 and being struck using conventional golf clubs towards the wall 19. The ball on striking the wall 19 will rebound say onto the green area 17 of the hole layout 11 and thence a conventional putter may be used to putt the ball into the hole 18. The position of rebound of the ball from the wall 19 is indicative of the position at which the ball hits the wall and the force applied thereto so as to give a true indication to the player as to whether the ball has been struck and aimed correctly. If the ball when struck from the tee area 13 does not reach the wall 19, it may again be struck with a club for example an iron so that it will rebound therefrom. If the ball on rebounding does not reach the green area 17, other clubs such as a pitching wedge may be used in conventional manner to hit the ball onto the green area 17. Similarly if the ball lands in the bunker 14, a sand wedge will be used.

It will be apparent from FIG. 1 that the layout of each hole may be varied with in some instances the green area 17 being located adjacent to the wall 19 so as to simulate a short hole where for example an eight or nine iron may be used whilst in other layout configurations the green area 17 may be placed adjacent to or rearwardly of the tee area 13 so that a driver will be required so as to enable the ball to rebound from the wall 19 substantially towards that green area 17. Any number of hole layout areas 11 may be provided with the preferred number being nine, twelve or eighteen and of course the hole layouts may be varied as desired.

Figure 4:
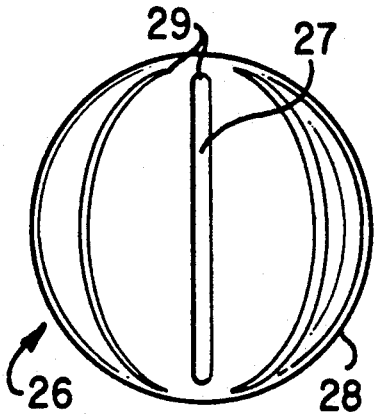
FIG. 4 is a side elevational view of a typical ball employed in the game of the present invention.
Figure 5:
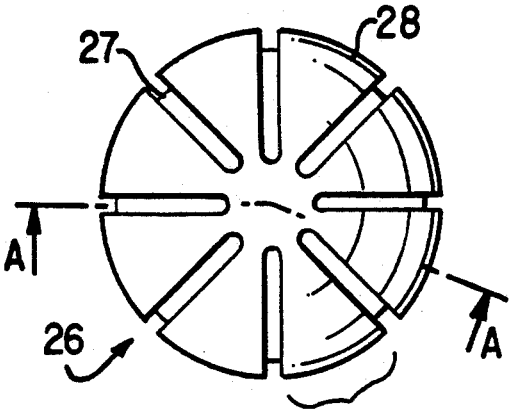
FIG. 5 is a plan view of the ball of FIG. 4.
Figure 6:
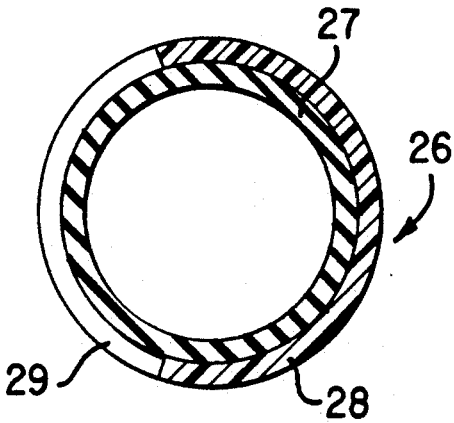
FIG. 6 is a cross-sectional view of the ball along line A—A of FIG. 5.

The present invention also provides a ball for use in the above game, the ball being formed so as to have a feel similar to the feel of a normal or standard golf ball when struck with a club and having a weight such that it will run in a similar manner to a normal golf ball but with less speed after losing momentum and energy upon striking the rebound surface 19. The ball also has a resilience such as to enable it to be used in the confined spaces of the hole layout area 11. One embodiment of ball 26 for this purpose is shown in FIGS. 4 to 6 and includes an inner core 27 which comprises a resilient ball and suitably a ball of natural or synthetic rubber such as a ball of the type used in the game of squash. Alternatively, the inner core 27 may be comprised of a solid resilient material or any other resilient material such as a sponge rubber or the like. In each case, the material forming the inner core 27 suitably has a hardness of fifty-five (55) to seventy-five (75) Durometer and most preferably where the inner core 27 comprises a squash-type ball, the core material has a hardness of sixty-five (65) Durometer.

The ball 26 also includes on its outer surface a hard layer 28 which for example may comprise polyurethane, a thermosetting plastic or polivinyl chloride (PVC). The thickness of the layer 28 is varied in accordance with the hardness required in that layer and for example where the layer comprises polyurethane the thickness is preferably in the range of one (1) to three (3) mm. and preferably 2 mm. so as to produce a hardness of ninety (90) to ninety-five (95) Durometer. Where polyvinyl chloride is used for the layer 28, its hardness is preferably in the range of eighty (80) to one hundred and five (105) Durometer.

In each instance, however, at least portion or portions of the inner core 27 are free of the layer 28. Preferably this is achieved by forming a plurality of circumferentially extending slits or slots 29 in the layer 28 so as to expose portions of the inner core 27. The slits or slots 29 may be formed after formation of the layer 28 or alternatively during the layer moulding process.

Figure 8:
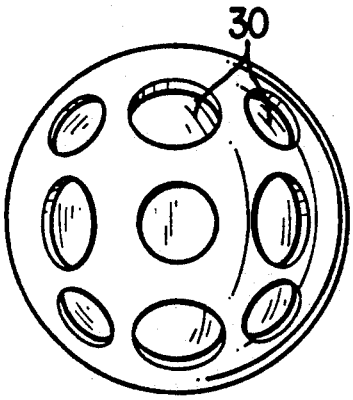
FIG. 8 illustrates an alternative ball construction for use in the game of FIG. 1.

Alternatively, the layer 28 may be provided with circular recesses 30 such as of the form shown in FIG. 8 so that portions of the core 27 are exposed. It will be apparent however, that the layer 28 may be cut away or removed in any other fashion and in any pattern so as to expose portions of the core 27.

Figure 7:
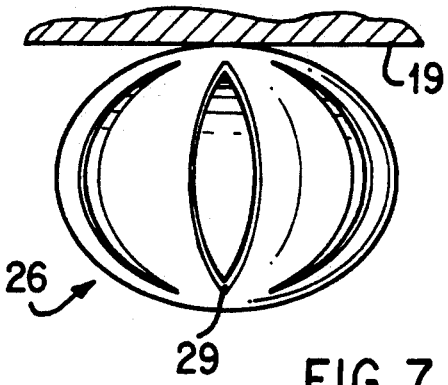
FIG. 7 illustrates the ball of FIGS. 4 and 5 undergoing deformation on striking the rebound surface.

Whatever pattern is used, the arrangement is such that the ball 26 when struck by a golf club has the feel of a conventional golf ball because of the presence of the outer hard layer 28. When the ball 26 strikes the wall 19 or other solid obstruction as shown in FIG. 7, however, the portions of the ball free of the hard layer 28 permit resilient deformation of the inner core 27 and the ball 26 to resiliently deform and lose substantial kinetic energy and thereafter rebound towards the green 16 to an extent determined by the impact force of the ball 26 against the wall 19.

The ball 26 is suitably substantially of the same size as a golf ball for example forty (40) to forty-six (46) mm. in diameter and has a weight of approximately 30 to 40 grams. The ball 26 also has a resilience or rebound preferably in the range of 17% to 25%. Use of the ball 26 of the above type permits a normal force as used in a golf swing to be applied but with a limited rebound because of the nature and arrangement of the hard layer 28 on the ball 26 whilst the ball 26 will, upon rebounding, run in the fashion of a normal golf ball. Thus the area required for playing the game according to the invention can be substantially reduced. So as to simulate the normal golf ball the outer surface of the ball 26 may be formed with a pattern of dimples or grooves as found in conventional golf balls.

The ball 26 may be manufactured by providing the inner core 27 and locating the core 27 in a mould after which an adhesive is applied to the outer surface of the core and the hard layer 28 cold moulded thereonto with the mould defining the required slits or slots 29 in the layer 28. Alternatively, the whole ball 26 including the core 27 may be formed in a single moulding operation.

Figure 9:
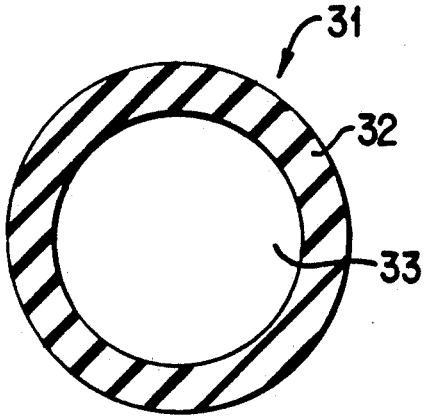
FIG. 9 illustrates in sectional view a further form of ball for use in the apparatus of the invention.

Similar properties to that described above may also be achieved with the ball 31 shown in FIG. 9. This ball 31 includes an outer wall 32 surrounding a hollow internal space 33. The wall 32 has a hardness sufficient to provide a feel when struck similar to the feel of a standard golf ball and an elasticity or resilience so that upon striking the wall, it resiliently deforms to absorb energy and rebounds therefrom to run on the fairway. Preferably, the wall 32 has a thickness in the range of 3 to 4 mm.

The wall 32 is suitably formed of a blended mixture of synthetic rubber vulcanizing material and a reinforcing or hardening agent or agents to provide a material with the desired hardening and elasticity. In one particularly preferred form, the wall is formed of rubber butadiene acrylonitrilene copolymer and a reinforcing or hardness agent or agents selected from the group of carbon black filling, silica, silicates, calcium carbonates and clay, suitably present in the rubber at between 50–200 pphr (parts per hundred rubber). The hardening and reinforcing agent or agents blended with the rubber material suitably provide a hardness of 70 to 90 Durometer and 10% to 40% resilience. Most suitably, the resilience is in the range of 15% to 25% with particularly preferred properties being achievable where the resilience is in the range of 18% to 23%. The ball 31 also has a weight suitably in the range of 35 to 45 grams. Balls formed as above may also be provided in their outer surface with a dimpled pattern as in normal golf balls.

Suitably the hole layouts 11 may be in the range of six meters in width by thirty meters in length to eight meters in width by forty meters in length with the ceiling net located at a height of approximately eight to ten meters. It will be apparent, however, that many variations in the above preferred configuration may be used for the game.

The present invention thus provides a game which requires similar skills for, and uses the same clubs as, the conventional game of golf. The game however being most suited to playing indoors may be played at any time of the day or night and in any weather conditions. Furthermore, whilst the game is particularly suited to indoor use, it may equally be played outdoors using the above described games equipment.

The game requires the full range of shots involved in a conventional game of golf and the game is played by traversing the course playing one hole after another as in the conventional game.

Many variations may be made to the above described game without departing from the broad scope and ambit thereof. For example, many course variations may be employed such as water courses or the like.

I claim:

1. Games apparatus for a golf-type game, said apparatus comprising:

a ground or floor surface, a tee area, a substantially planar rigid rebound surface at a position spaced from said tee area, a hole layout area including said tee area, said hole layout area terminating at said rebound surface, said hole layout area including a hole, and a ball having hardness in the range of 70–105 Durometer, and a resilience or rebound in the range of 10%–40% so that said ball will resiliently deform and lose kinetic energy on striking said rebound surface, so that a ball hit from said tee area toward said rebound surface may strike said rebound surface so as to rebound therefrom towards said hole.

2. Games apparatus according to claim 1 wherein said hole layout area has opposite longitudinal sides, and there being provided upright barrier means along said opposite longitudinal sides of said hole layout area.

3. Games apparatus according to claim 2 wherein said upright barrier means comprises netting.

4. Games apparatus according to claim 2 and further including top barrier means disposed above said hole layout area.

5. Games apparatus according to claim 1 wherein said ball has an inner resilient core and an outer surface layer and wherein at least a portion or portions of said inner core are free of said outer layer to permit said ball to resiliently deform on being struck or on striking a surface.

6. Games apparatus according to claim 5 wherein said portions free of said outer layer are defined by a plurality of circumferentially extending slits or slots in said outer surface layer.

7. Games apparatus according to claim 5, wherein said portions free of said outer layer are defined by a plurality of apertures or holes in the outer layer.

8. Games apparatus according to claim 5 wherein said core comprises a hollow ball formed of a rubber or synthetic rubber material.

9. Games apparatus according to claim 8 wherein said synthetic rubber vulcanizing agent comprises rubber butadiene-acrylonitrilene copolymer.

10. Games apparatus according to claim 1 wherein said ball comprises a ball having an outer wall and an inner hollow space, said outer wall being formed of a material having a hardness in the range of 70 to 90 Durometer.

11. Games apparatus according to claim 10 wherein said outer wall is formed of a blended mixture of a synthetic rubber vulcanizing material or materials and a reinforcing or hardening agent or agents.

12. Games apparatus according to claim 11 wherein said reinforcing or hardening agents are selected from one or more of the group of carbon black, silica, silicates, calcium carbonates, or clays.

13. Games apparatus according to claim 12 wherein said reinforcing agents are present in said outer layer in the range of 50–200 parts per hundred rubber.

14. Games apparatus for a golf-type game, said apparatus comprising:

a ground or floor surface, a tee area, a substantially planar upright rigid rebound surface at a position spaced from said tee area, an elongated hole layout area on said ground or floor surface having opposite longitudinal sides, said hole layout area including said tee area, said hole layout area terminating at said rebound surface, upright side barrier means in the form of netting on said opposite sides of said hole layout area, top barrier means in the form of netting above said hole layout area including a hole, and a ball having a weight in the range of 20–60 grams, a hardness in the range of 70–90 Durometer, and a resilience or rebound in the range of 10%–40% so that said ball will resiliently deform and lose kinetic energy on striking said rebound surface, and such that a ball hit from said tee area towards said rebound surface will strike said rebound surface so as to rebound therefrom towards said hole.

15. Games apparatus according to claim 14 wherein said ball has a resilience in the range of 15–25%.

16. Games apparatus according to claim 14 wherein said ball comprises a hollow ball having a weight in the range of 35–45 grams.

17. Games apparatus according to claim 16 wherein said ball has an outer wall formed of a blended mixture of synthetic rubber vulcanizing material and a reinforced or hardening agent.

* * * * *